US011442396B2

(12) United States Patent
Watanabe et al.

(10) Patent No.: US 11,442,396 B2
(45) Date of Patent: Sep. 13, 2022

(54) CLEANING BLADE, SHEET CONVEYANCE ROLLER, PROCESS CARTRIDGE, AND IMAGE FORMING APPARATUS

(71) Applicants: Kazuhiko Watanabe, Tokyo (JP); Hiroshi Nakai, Kanagawa (JP); Masahiro Ohmori, Kanagawa (JP)

(72) Inventors: Kazuhiko Watanabe, Tokyo (JP); Hiroshi Nakai, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/142,650

(22) Filed: Jan. 6, 2021

(65) Prior Publication Data

US 2021/0216032 A1 Jul. 15, 2021

(30) Foreign Application Priority Data

Jan. 14, 2020 (JP) ..... JP2020-003486

(51) Int. Cl.
*G03G 21/00* (2006.01)
*G03G 21/18* (2006.01)

(52) U.S. Cl.
CPC ..... *G03G 21/0017* (2013.01); *G03G 21/1814* (2013.01)

(58) Field of Classification Search
CPC ..... G03G 21/0017; G03G 21/1814
See application file for complete search history.

(56) References Cited

U.S. PATENT DOCUMENTS

| | | | | |
|---|---|---|---|---|
| 10,514,651 | B1 | 12/2019 | Watanabe et al. | |
| 2010/0247190 | A1* | 9/2010 | Shirai | G03G 21/0017 399/350 |
| 2013/0223886 | A1* | 8/2013 | Miyagawa | G03G 15/0233 399/176 |
| 2015/0241817 | A1 | 8/2015 | Kubo et al. | |
| 2016/0370719 | A1* | 12/2016 | Arimura | G03G 5/105 |
| 2017/0369704 | A1* | 12/2017 | Hayashi | C08G 18/48 |
| 2018/0017930 | A1 | 1/2018 | Aoyama et al. | |
| 2018/0196387 | A1 | 7/2018 | Watanabe | |
| 2018/0373198 | A1 | 12/2018 | Mizusawa et al. | |

FOREIGN PATENT DOCUMENTS

| | | |
|---|---|---|
| JP | 2010-139737 | 6/2010 |
| JP | 2011-248288 | 12/2011 |
| JP | 2012-181244 | 9/2012 |
| JP | 2013-029632 | 2/2013 |
| JP | 2014-066857 | 4/2014 |
| JP | 2015-158574 | 9/2015 |
| JP | 2015-158608 | 9/2015 |
| JP | 2015-232589 | 12/2015 |
| JP | 2016-031375 | 3/2016 |
| JP | 2016-109867 | 6/2016 |
| JP | 2016-114685 | 6/2016 |
| JP | 2016-114891 | 6/2016 |

(Continued)

*Primary Examiner* — Sandra Brase
(74) *Attorney, Agent, or Firm* — Harness, Dickey & Pierce, P.L.C.

(57) ABSTRACT

A cleaning blade includes a blade member including a ridgeline portion. The ridgeline portion contains polyrotaxane. A sheet conveyance roller includes a core and a surface layer. The surface layer contains polyrotaxane.

12 Claims, 10 Drawing Sheets

(56) References Cited

FOREIGN PATENT DOCUMENTS

| | | | |
|---|---|---|---|
| JP | 2016-173462 | | 9/2016 |
| JP | 2016-204435 | | 12/2016 |
| JP | 2017-003935 | | 1/2017 |
| JP | 2017-010013 | | 1/2017 |
| JP | 2017-116593 | | 6/2017 |
| WO | WO2013/094127 | A1 | 6/2013 |
| WO | WO2013/094129 | A1 | 6/2013 |

* cited by examiner

CLEANING BLADE, SHEET CONVEYANCE ROLLER, PROCESS CARTRIDGE, AND IMAGE FORMING APPARATUS

CROSS-REFERENCE TO RELATED APPLICATION

This patent application is based on and claims priority pursuant to 35 U.S.C. § 119 to Japanese Patent Application No. 2020-003486, filed on Jan. 14, 2020 in the Japan Patent Office, the entire disclosure of which is hereby incorporated by reference herein.

BACKGROUND

Technical Field

Embodiments of the present disclosure generally relate to a cleaning blade, a sheet conveyance roller, a process cartridge, and an image forming apparatus.

Background Art

A general image forming apparatus includes a cleaning blade having a blade member. A ridgeline portion of the blade member contacts a surface of an object to be cleaned that moves in contact with the ridgeline portion and removes substances adhering to the surface of the object.

SUMMARY

This specification describes an improved cleaning blade that includes a blade member including a ridgeline portion. The ridgeline portion contains polyrotaxane.

This specification further describes an improved sheet conveyance roller that includes a core and a surface layer. The surface layer contains polyrotaxane.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
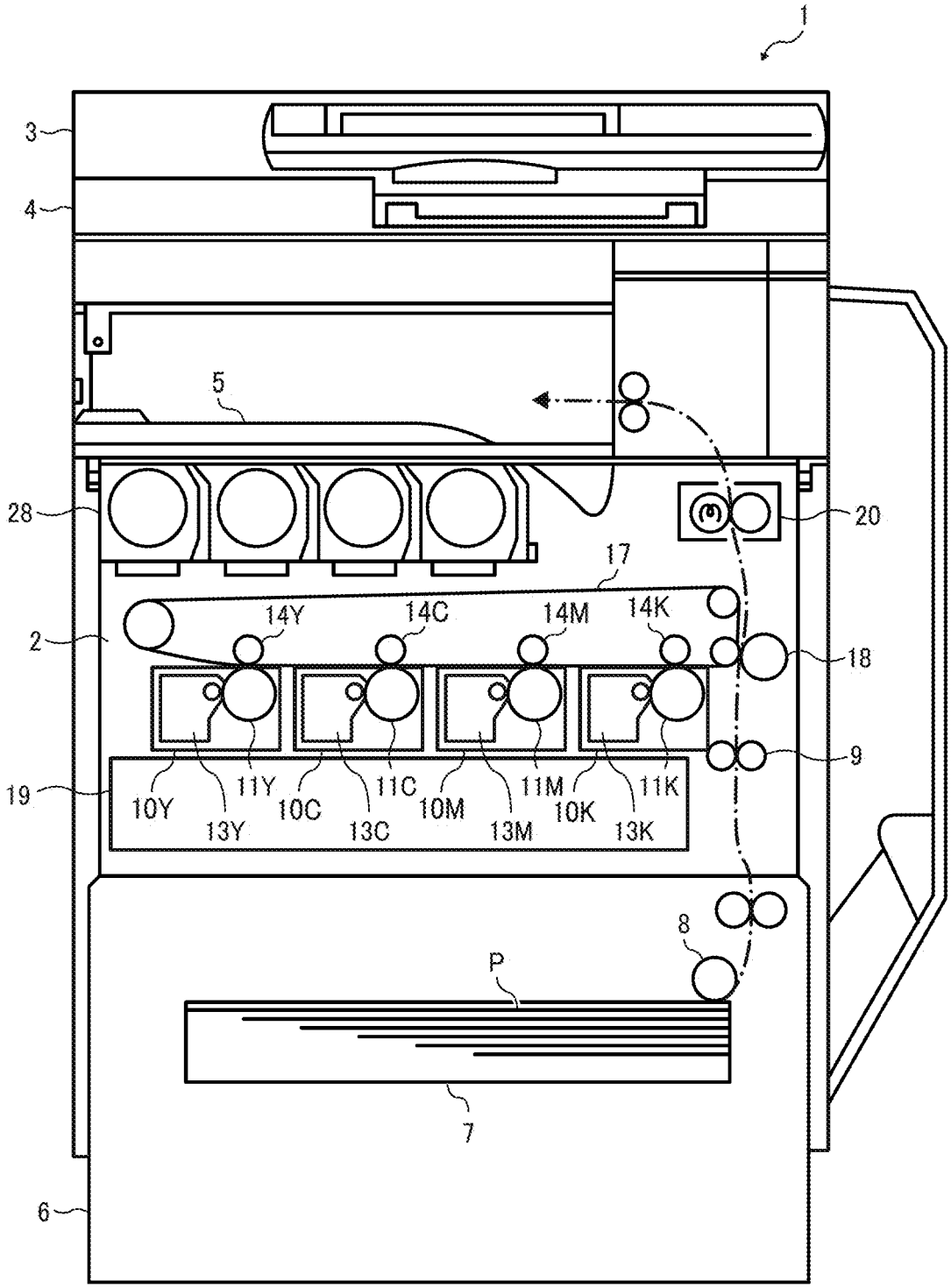
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure, and all of the components or elements described in the embodiments of this disclosure are not necessarily indispensable.

Descriptions are given below of an embodiment in which a cleaning device according to the present disclosure is set in a tandem-type full-color image forming apparatus using an intermediate transfer method (hereinafter, simply called "the image forming apparatus").

FIG. 1 is a schematic view of an image forming apparatus 1 according to the present embodiment.

The image forming apparatus 1 includes an automatic document feeder (ADF) 3 and a document reader 4 on the top of a main body of the image forming apparatus 1. Below the document reader 4, the image forming apparatus 1 includes a stack unit 5 to stack a recording sheet P on which an image has been formed. Under the stack unit 5, the image forming apparatus 1 includes an image forming section 2 to form an image based on a document image read by the document reader 4 and a sheet feeder 6 to feed the recording sheet P to the image forming section 2.

The ADF 3 separates the document one by one from a document bundle and automatically feeds the document onto an exposure glass of the document reader 4, and the document reader 4 reads the document fed onto the exposure glass.

The image forming section 2 includes an intermediate transfer belt 17 that is taut around a plurality of support rollers and rotates counterclockwise in FIG. 1. Additionally, on the underside of the intermediate transfer belt 17, image forming units 10Y, 10C, 10M, and 10K are arranged in parallel and form yellow, cyan, magenta, and black toner images, respectively. The image forming units 10Y, 10C, 10M, and 10K include photoconductors 11Y, 11C, 11M, and 11K, respectively, to form color toner images. Each of the photoconductors 11Y, 11C, 11M, and 11K is surrounded by a charger, each of developing devices 13Y, 13C, 13M, and 13K, and a photoconductor cleaning device in the image forming section 2.

The image forming section 2 includes primary transfer rollers 14Y, 14C, 14M, and 14K that contact the inner circumferential surface of the intermediate transfer belt 17 opposite the photoconductors 11Y, 11C, 11M, and 11K. Additionally, the image forming section 2 includes a secondary transfer roller 18 that contacts an outer circumferential surface of the intermediate transfer belt 17 downstream from the primary transfer rollers 14Y, 14C, 14M, and 14K in a surface movement direction of the intermediate transfer belt 17. In addition, the image forming section 2 includes a belt cleaner that contacts an outer circumferential surface of the intermediate transfer belt 17 downstream from the secondary transfer roller 18 in the surface movement direction of the intermediate transfer belt 17. Above the secondary transfer roller 18, a fixing device 20 is disposed.

Below the image forming units 10Y, 10C, 10M, and 10K, the image forming section 2 includes an optical writing device 19 to emit laser light to the photoconductors 11Y, 11C, 11M, and 11K. Additionally, a toner supply device 28 is disposed above the intermediate transfer belt 17. The toner supply device 28 includes four toner cartridges (toner containers) that correspond to yellow, cyan, magenta, and black colors and are removably installed in the toner supply device 28. That is, the toner cartridges are replaceable. In addition to the toner cartridges, the toner supply device 28 includes toner conveyance devices to transport toner supplied from the toner cartridges to the developing devices 13Y, 13C, 13M, and 13K.

The sheet feeder 6 includes a sheet tray 7 to store a plurality of stacked recording sheets P and a sheet feed roller 8 to feed a recording sheet P on the top of the plurality of stacked recording sheets P to the image forming section 2.

Image forming processes performed by the above-described image forming apparatus 1 are described.

In the image forming apparatus 1, each of the image forming units 10Y, 10C, 10M, and 10K forms each color toner image. Firstly, each of the photoconductors 11Y, 11C, 11M, and 11K rotates, and the charger uniformly charges a surface of each of the photoconductors 11Y, 11C, 11M, and 11K. Subsequently, the optical writing device 19 emits the laser light to the surface of each of the photoconductors 11Y, 11C, 11M, and 11K to form electrostatic latent images on the photoconductors 11Y, 11C, 11M, and 11K based on color separation image data generated from document image data read by the document reader 4. After that, the developing devices 13Y, 13C, 13M, and 13K adhere toner onto the electrostatic latent images to form visible color toner images on the photoconductors 11Y, 11C, 11M, and 11K, respectively.

The primary transfer rollers 14Y, 14C, 14M, and 14K sequentially transfer the color toner images on the photoconductors 11Y, 11C, 11M, and 11K onto the intermediate transfer belt 17 to form a superimposed color toner image on the intermediate transfer belt 17. After transfer of the color toner images onto the intermediate transfer belt 17, the photoconductor cleaning devices 15Y, 15C, 15M, and 15K clean the surfaces of the photoconductors 11Y, 11C, 11M, and 11K by removing residual toner remaining on the surfaces of the photoconductors 11Y, 11C, 11M, and 11K to be ready for a subsequent image forming operation.

On the other hand, in the sheet feeder 6, the recording sheets P stored in the sheet tray 7 are separated one by one, and the sheet feed roller 8 feeds the separated recording sheet P to the image forming section 2. The recording sheet P contacts the registration rollers 9 and stops. In synchronization with timing of toner image formation in the image forming section 2, the registration rollers 9 convey the recording sheet P contacted and stopped at the registration rollers 9 to a secondary transfer area between the intermediate transfer belt 17 and the secondary transfer roller 18. In the secondary transfer area, the secondary transfer roller 18 transfers the superimposed color toner image on the intermediate transfer belt 17 onto the recording sheet P conveyed by the registration rollers 9. The secondary transfer roller 18 conveys the recording sheet P bearing the superimposed color toner image to the fixing device 20. The fixing device 20 fixes the superimposed color toner image onto the recording sheet P, and the recording sheet P is ejected to the stack unit 5. After transfer of the superimposed color toner image onto the sheet P, the belt cleaner cleans the surface of the intermediate transfer belt 17 by removing residual toner remaining on the surface of the intermediate transfer belt 17 to be ready for a subsequent image forming operation.

In the present embodiment, each of the image forming units 10Y, 10C, 10M, and 10K is configured as a process cartridge that is removably attached to the image forming apparatus body as a single unit and includes each of the photoconductors 11Y, 11C, 11M, and 11K, the charger, each of the developing devices 13Y, 13C, 13M, and 13K, and the photoconductor cleaning device, which are supported by a common frame. The configuration as the process cartridge improves the workability for maintenance.

Figure 2:
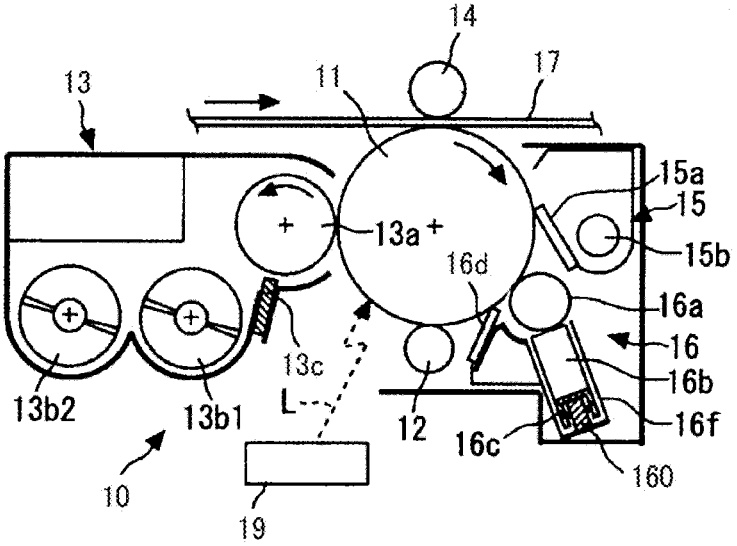
FIG. 2 is a schematic view of an image forming unit according to an embodiment of the present disclosure.

FIG. 2 is a schematic view of one of the image forming units 10Y, 10C, 10M, and 10K.

The four image forming units 10Y, 10C, 10M, and 10K have a similar configuration except the color of toner used in the image forming processes. Therefore, the image forming units, the developing devices, and the toner supply device are illustrated without suffixes Y, M, C, and K, which denote the colors of toner, in FIG. 2.

As illustrated in FIG. 2, in the image forming unit 10Y, the photoconductor drum 11 as the image bearer and a member to be cleaned, the charger 12 (that is a charging roller), the developing device 13, the photoconductor cleaning device 15, and a lubricant supply device 16 are combined together as a single unit in a case. Each of the replaceable image forming units 10Y, 10M, 10C, and 10BK is removably installable in the image forming apparatus 1. The charger 12 (that is, the charging roller) charges the photoconductor 11. The developing device 13 develops an electrostatic latent image formed on the photoconductor 11. The photoconductor cleaning device 15 removes and collects the untransferred toner on the photoconductor 11. The lubricant supply device 16 supplies lubricant onto the photoconductor 11.

The charger 12 is disposed opposite the surface of the photoconductor 11 and mainly configured by the charging roller to which a charging voltage is applied.

The developing device 13 mainly includes a developing roller 13*a* serving as a developer bearer, a stirring screw 13*b*2, a supply screw 13*b*1, and a doctor blade 13*c*. The developing roller 13*a* bears the developer thereon. The stirring screw 13*b*2 stirs and conveys the developer accommodated in a developer container. The supply screw 13*b*1 conveys the stirred developer while supplying the developer to the developing roller 13*a*. The doctor blade 13*c* faces the developing roller 13*a* to regulate the developer on the developing roller 13*a*. In the developing device 13, the stirring screw 13*b*2 stirs and conveys the developer stored in the developer container, and the supply screw 13*b*1 conveys the developer while supplying the stirred developer to the developing roller 13*a*. The developing roller 13*a* supplies toner to the surface of the photoconductor 11 to develop the electrostatic latent image formed thereon.

The photoconductor cleaning device 15 as a cleaning device includes a cleaning blade 15*a*. The cleaning blade 15*a* is made of insulative and elastic material having $1\times10^{10}$ Ω·cm or more in volume resistivity such as urethane rubber, in one layer or two layers. A ridgeline portion of the cleaning blade 15*a* facing the photoconductor 11 contacts the surface of the photoconductor 11 and cleans the surface of the photoconductor 11. Substances adhering on the photoconductor 11, such as residual toner and the like, are removed by the cleaning blade 15*a*, fall onto the photoconductor cleaning device 15, and are conveyed to a waste toner collection container by a conveyance coil 15*b* disposed in the photoconductor cleaning device 15. Details of the cleaning blade 15*a* are described later.

The lubricant supply device 16 includes a blade 16*d*, a solid lubricant 16*b*, a lubricant supply roller 16*a*, a holder 16*c*, a case 16*f*, and a pressing device 160. The lubricant supply roller 16*a* contacts and slides on the photoconductor 11 and the solid lubricant 16*b*. The holder 16*c* holds the solid lubricant 16*b*. The case 16*f* houses the holder 16*c* together with the solid lubricant 16*b*. The pressing device 160 presses the solid lubricant 16*b* together with the holder 16*c* toward the lubricant supply roller 16*a*.

In the lubricant supply device 16, the lubricant supply roller 16*a* applies the solid lubricant 16*b* to the surfaces of the photoconductor 11, and the blade 16*d* (that is, a leveling blade) levels off the lubricant for forming a film of the lubricant on the surface of the photoconductor 11.

Next, a description is given of details of the present embodiment.

FIGS. 3A to 3E are schematic views illustrating configurations of cleaning blades 15*a* of embodiments of the present disclosure. The cleaning blade 15*a* includes a blade member 15*a*1 and a metallic blade holder 15*a*2 to hold the blade member 15*a*1. The blade member has the ridgeline portion 151*c* to contact the photoconductor 11.

Figure 3A:
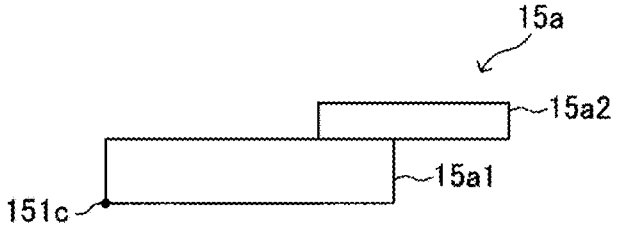
FIGS. 3A to 3E are schematic views illustrating configurations of cleaning blades of embodiments of the present disclosure.
Figure 3B:
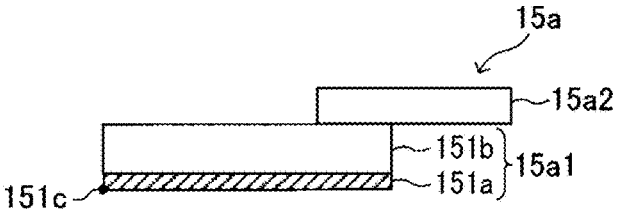
Figure 3C:
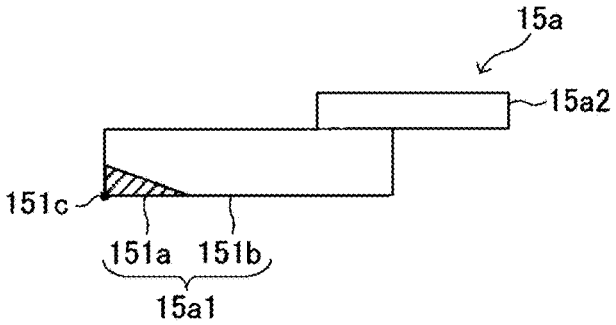
Figure 3D:
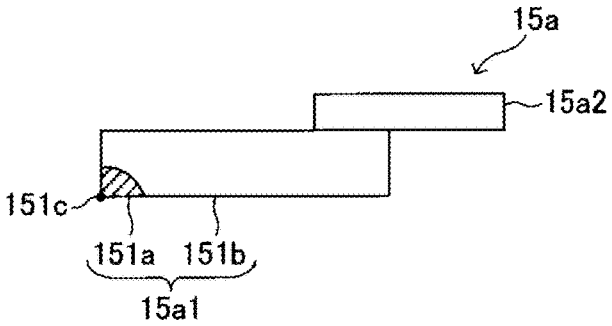
Figure 3E:
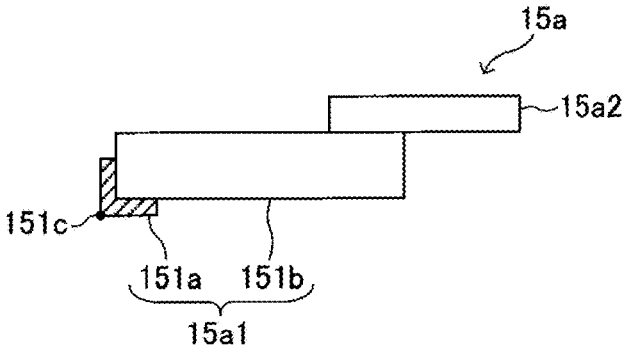
Figure 4A:
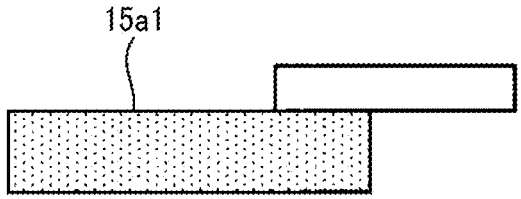
FIGS. 4A to 4J are schematic views illustrating cleaning blades each containing polyrotaxane as a bulk and cleaning blades not each containing polyrotaxane as a bulk.
Figure 4B:
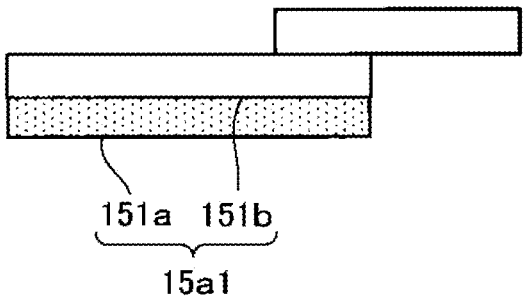
Figure 4C:
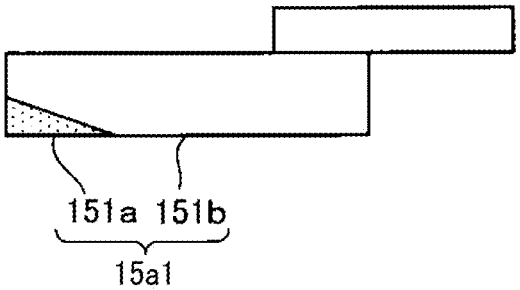
Figure 4D:
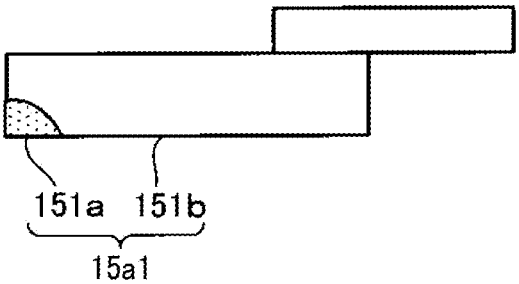
Figure 4E:
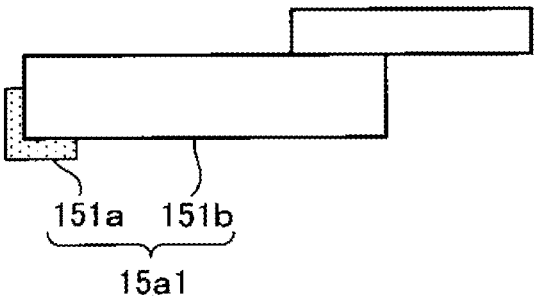
Figure 4F:
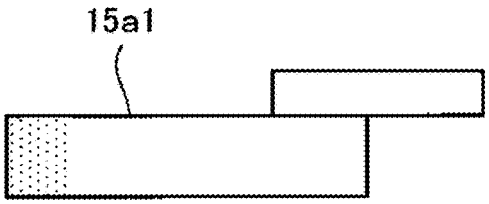
Figure 4G:
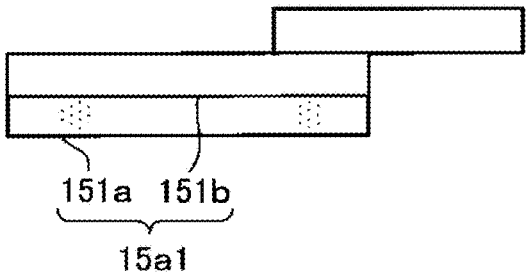
Figure 4H:
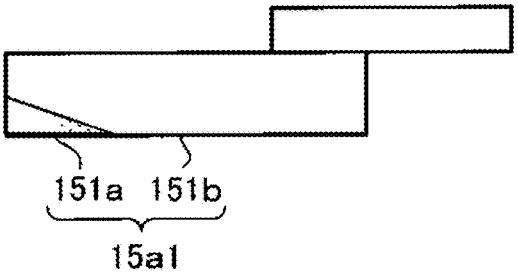
Figure 4I:
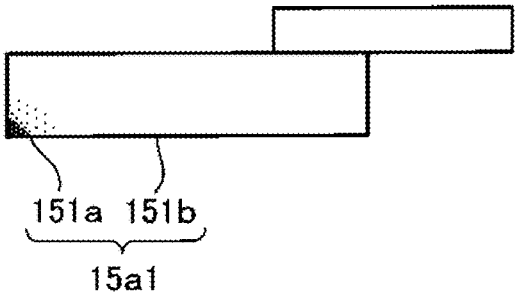
Figure 4J:
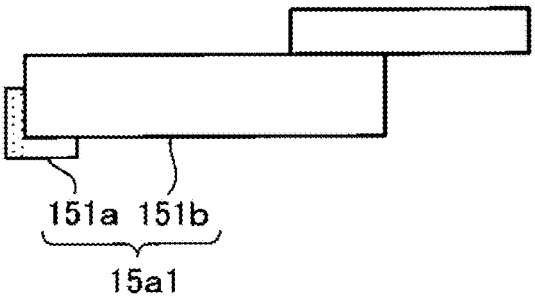

The blade member 15*a*1 may have a single-layer structure formed of an elastic body as illustrated in FIG. 3A or a two-layer structure including of an edge layer 151*a* formed of an elastic body including the ridgeline portion 151*c* and a backup layer 151*b* formed of an elastic body as illustrated in FIGS. 3B to 3E. The blade members 15*a*1 in FIGS. 3B to 3D are made by using centrifugal molding to sequentially superimpose layers. The blade member 15*a*1 in FIG. 3E includes the edge layer 151*a* formed by using spray coating, dip coating, or the like and coating the ridgeline portion of the rectangular backup layer 151*b*. The above-described elastic body has a Martens hardness of 5 or less.

The blade member 15*a*1 is an insulator having a volume resistivity of $1\times10^{10}$ Ω·cm or more. In the blade member 15*a*1 having the two-layer structure, both the edge layer 151*a* and the backup layer 151*b* have the volume resistivity of $1\times10^{10}$ Ω·cm or more.

The layer including at least the ridgeline portion 151*c* in the blade member 15*a*1 contains polyrotaxane as a bulk. Specifically, the blade member 15*a*1 having the single-layer structure as illustrated in FIG. 3A contains polyrotaxane as a bulk in the blade member 15*a*1 itself. On the other hand, the blade member 15*a*1 having the two-layer structure as illustrated in each of FIGS. 3B to 3E contains polyrotaxane as a bulk at least in the edge layer 151*a*. The blade member 15*a*1 having the two-layer structure may contain the polyrotaxane as a bulk in both the edge layer 151*a* and the backup layer 151*b*.

The above expression "contains the polyrotaxane as a bulk" means that the polyrotaxane is uniformly dispersed in the layer. FIGS. 4A to 4E illustrate the blade members 15*a*1 containing the polyrotaxane as a bulk in the at least part of each of the blade members 15*a*1. The polyrotaxane is expressed by dots in FIGS. 4A to 4J. On the other hand, the blade members 15*a*1 illustrated in FIGS. 4F to 4H and 4J contain the polyrotaxane unevenly distributed and do not contain the polyrotaxane as a bulk. The blade member 15*a*1 illustrated in FIG. 41 is made by impregnation treatment to have the polyrotaxane concentrations different in locations of the blade member 15*a*1 and does not contain the polyrotaxane as a bulk. Containing the polyrotaxane as a bulk" means that the material constituting the blade contains the polyrotaxane and does not mean adding the polyrotaxane to the blade by impregnation and coating the polyrotaxane to the blade. For example, in samples of the cleaning blades according to embodiments described below, the polyrotaxane and prepolymer were mixed and stirred to make urethan rubber constituting the blade so that the polyrotaxane was contained in the blade as a bulk.

The polyrotaxane added as a bulk is also referred to as crosslinked polyrotaxane.

A capability of the cleaning blade 15*a* to mechanically remove the substances adhering on the photoconductor 11 is required to be maintained over time and for any environment (low temperature, normal temperature, high temperature). The performance of the cleaning blade influences the life of the image forming unit 10. The demand for prolonging the life of the image forming unit 10 requires prolonging the life of the cleaning blade 15*a*, which brings about issues such as improvement of the wear resistance and keeping the toner removing capability for any environment.

Deterioration in the capability of the cleaning blade 15*a* to mechanically remove the substances adhering on the photoconductor 11 causes the toner to pass through the cleaning blade 15*a*, which causes the following two disadvantages. One is increase of toner contamination on the charging roller 12*a* located downstream from the cleaning blade 15*a*, which is caused by the toner slipping between the cleaning blade and the photoconductor. The toner contamination on the charging roller 12*a* causes defective charging such as uneven charging that results in abnormal images such as streaks and uneven image density.

The other is increase of toner contamination on the lubricant supply roller 16*a* caused by the toner slipping between the cleaning blade 15*a* and the photoconductor. The toner contamination on the lubricant supply roller 16*a* increase capability scraping off the solid lubricant 16*b* that results in excessive application of the lubricant to the photoconductor. The excessive application of the lubricant to the photoconductor causes lubricant contamination on the charging roller 12*a* and is likely to cause uneven application of the lubricant to the photoconductor 11 because the excess lubricant is not uniformly applied. The uneven application of the lubricant causes a variation in charging property of the photoconductor 11 that causes a variation in surface potential, which causes uneven image density.

The cleaning blade 15*a* to mechanically remove the substances adhering on the photoconductor 11 is different from a cleaning device in which a member applied a voltage electrostatically removes the substances such as toner adhering on the photoconductor 11 as a cleaning target. The cleaning blade 15*a* contacts the photoconductor with a large contact pressure. In the cleaning blade 15*a* to mechanically remove the substances adhering on the photoconductor 11, the ridgeline portion 151*c* performs stick-slip movement and is easily worn. The wear of the ridgeline portion 151*c* greatly affects the capability of the cleaning blade 15*a* to mechanically remove the substances adhering on the photoconductor 11. The wear of the ridgeline portion 151*c* of the cleaning blade 15*a* is caused by the breakages of the molecular chains of the urethane rubber polymer in the ridgeline portion 151*c*, which is caused by the stick-slip movement. The breakages of the molecular chains of the urethane rubber polymer is affected by the magnitude of the accumulated stress concentrated on a portion including the ridgeline portion 151*c*. Decreasing the accumulated stress applied to the molecular chains of the urethane rubber polymer reduces the breakages of the molecular chains and the wear. However, the stick-slip movement of the ridgeline portion 151*c* increases the accumulated stress and the breakage of the molecular chains of the urethane rubber polymer, and the breakage of the molecular chains increases the wear.

The image forming apparatus is used not only in an office environment in which air conditioning is managed but also in various temperature and humidity environments from a low temperature and low humidity environment to a high temperature and high humidity environment. Outside working hours, the office environment becomes the low temperature and low humidity or the high temperature and high humidity because the air conditioning is not managed. Accordingly, immediately after the start of the air conditioning, an environment in the image forming apparatus is likely to be the low temperature and low humidity or the high temperature and high humidity because the environment in the image forming apparatus does not become the set temperature and humidity of the air conditioning immediately after the start of the air conditioning.

When the image forming apparatus is exposed to the low temperature and low humidity or the high temperature and high humidity, the cleaning blade 15*a* disposed in the image forming apparatus is also exposed to the low temperature and low humidity or the high temperature and high humidity. Change in the temperature and humidity affects and changes rubber physical properties of the elastic rubber constituting the cleaning blade 15*a*. Change in the contact pressure caused by a decrease in rubber elasticity in the low temperature and change in the contact pressure caused by a decrease in rubber hardness in the high temperature may cause disadvantages in the cleaning blade 15*a* such as squeaking and abnormal noise and deterioration in cleaning performance caused by a decrease in mechanical strength in the high humidity (that is, promotion of hydrolyzation).

In the cleaning blade 15*a* of the present embodiment, adding the polyrotaxane to the layer including the ridgeline portion 151*c* as described above improves wear resistance and the cleaning performance in a low temperature environment.

The following chemical formula 1 is the structural formula of rotaxane.

[Chemical Formula 1]

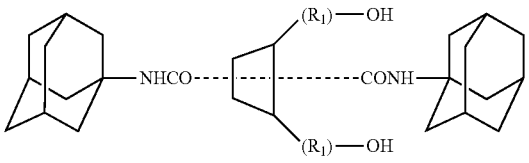

The above-described chemical formula 1 illustrates a rotaxane structure in which a linear polymer penetrates a cyclic molecule composed of cyclodextrin, and both ends of the linear polymer are fixed by large molecules such as adamantane groups so that the cyclic molecule does not come off. The above-described structure enables the cyclic molecule to freely move on the linear polymer. In the polyrotaxane, the linear polymer penetrates a large number of cyclic molecules. Cyclodextrin is a constituent molecule of the cyclic molecule and has a large number of hydroxyl groups. When these hydroxyl groups are used as crosslinking points to crosslink the cyclic molecules with each other or the cyclic molecules with another polymer (for example, urethane rubber), the crosslinking points move freely, and a pulley effect is obtained in which the crosslinking points function like pulleys.

Examples of the polyrotaxane include an ether-based polyrotaxane and an ester-based polyrotaxane. An example of the ether-based polyrotaxane is a polytetramethylene ether glycol (PTMG) chain polyrotaxane. An example of the ester-based polyrotaxane is polyrotaxane of caprolactone chains manufactured by Advanced Soft Materials Co., Ltd that is the old company name and is referred to as ASM Inc. below.

Figure 5A:
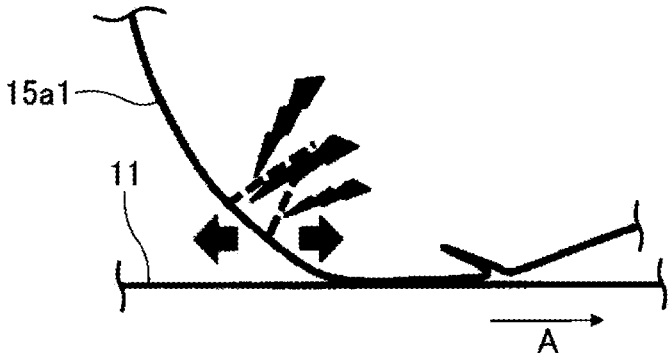
FIG. 5A is a schematic enlarged view of a ridgeline portion of a cleaning blade made of urethane rubber not containing polyrotaxane.
Figure 5B:
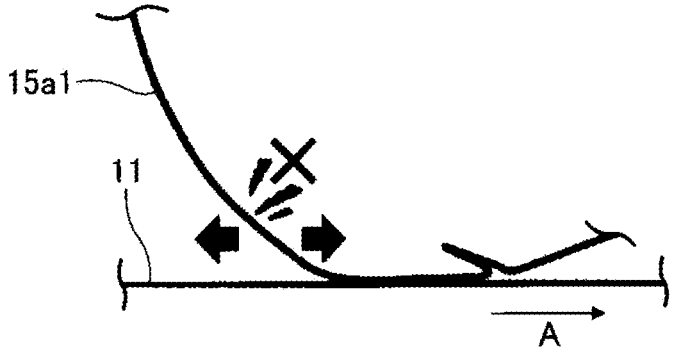
FIG. 5B is a schematic enlarged view of a ridgeline portion of a cleaning blade made of urethane rubber containing polyrotaxane.

FIG. 5A is a schematic enlarged view of the ridgeline portion 151*c* of the cleaning blade 15*a* made of urethane rubber not containing polyrotaxane. FIG. 5B is a schematic enlarged view of the ridgeline portion 151*c* of the cleaning blade 15*a* made of urethane rubber containing polyrotaxane.

In the cleaning blade 15*a* that mechanically removes the substances from the photoconductor 11, the stick-slip movement occurs in the ridgeline portion 151*c*. As illustrated in FIGS. 5A and 5B, the ridgeline portion 151*c* is pulled in a direction of movement of the photoconductor indicated by an arrow A in FIGS. 5A and 5B and returns to the original position in the stick-slip movement. The above-described stick-slip movement at the ridgeline portion 151*c* causes repeated stress concentration at the cross-linking points in the cleaning blade 15*a*. The repeated stress concentration often cuts and breaks the molecular chains in the cleaning blade 15*a*. As a result, in the cleaning blade which does not contain polyrotaxane in the ridgeline portion 151*c*, fatigue fracture occurs as illustrated by a broken line in FIG. 5A, and the cleaning blade wears.

In contrast, the above-described pully effect in the cleaning blade including the ridgeline portion 151*c* made of urethane rubber containing polyrotaxane prevents the stress concentration at the cross linking points even when the stick-slip movement occurs in the ridgeline portion 151*c* as illustrated in FIG. 5B. As a result, in the cleaning blade including the ridgeline portion 151*c* made of urethane rubber containing polyrotaxane, the molecular chains are hardly cut and broken, which sufficiently reduces the wear of the blade member 15*a*1 due to fatigue fracture. As described above, the cleaning blade 15*a* including the ridgeline portion 151*c* made of urethane rubber containing polyrotaxane has greatly improved wear resistance and a long life.

Figure 6A:
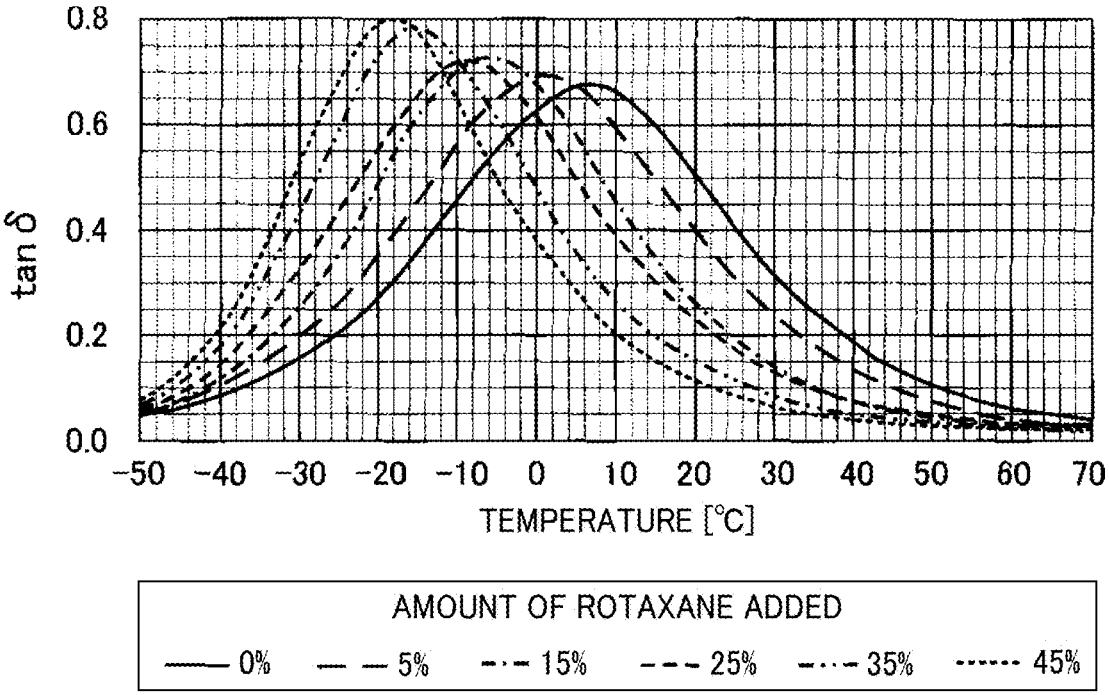
FIG. 6A is a graph illustrating relations between tan δ and temperature in some types of urethane rubber containing different amounts of polyrotaxane added.
Figure 6B:
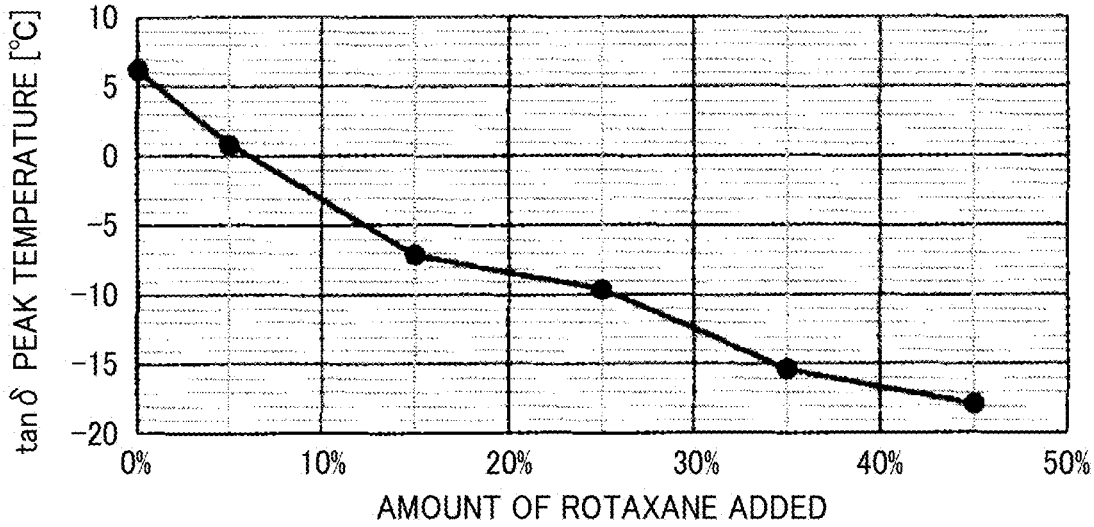
FIG. 6B is a graph illustrating a relation between the amounts of polyrotaxane added and tan δ peak temperatures.

Table 1 below illustrates physical properties of urethane rubbers added different amounts of polyrotaxane. FIG. 6A is a graph illustrating relations between tan δ and temperature in some types of urethane rubber added different amounts of polyrotaxane. FIG. 6B is a graph illustrating a relation between the amounts of polyrotaxane added and tan δ peak temperatures.

TABLE 1

| | | Sample No. | | | | | |
|---|---|---|---|---|---|---|---|
| | | 1 | 2 | 3 | 4 | 5 | 6 |
| Rotaxane is added or not | | None | | | Added | | |
| Ratio of functional groups to all hydroxyl groups in curing agent | difunctional monomers | 5% | 5% | 5% | 5% | 5% | 5% |
| | trifunctional monomers (TMP) | 95% | 90% | 80% | 70% | 60% | 50% |
| | polyfunctional monomers (i.e. rotaxane) | 0% | 5% | 15% | 25% | 35% | 45% |
| Mechanical strength | JIS A Hardness [°] (Japanese Industrial Standards (JIS)) | 61 | 64 | 64 | 64 | 63 | 63 |
| | Impact Resilience Modulus [%] | 28 | 32 | 45 | 52 | 58 | 63 |
| | Young's modulus [Mpa]5.2 | 5.2 | 5.7 | 7.4 | 6.6 | 5.7 | 5.8 |
| | M100 [MPa] (tensile stress) | 2.4 | 2.8 | 3.6 | 3.4 | 3.2 | 3.1 |
| | M200 [MPa] (tensile stress) | 4.4 | 8.1 | 10.9 | 12.6 | — | — |
| | M300 [MPa] (tensile stress) | 15.1 | — | — | — | — | — |
| | Tensile strength [MPa] | 18.0 | 22.2 | 22.8 | 14.5 | 8.7 | 5.7 |
| | Break elongation [%] | 307.0 | 279.1 | 237.4 | 207.6 | 190.3 | 155.7 |
| Viscoelasticity [10 Hz] | tan δ peak [° C.] | 6.2 | 0.9 | −7.1 | −9.6 | −15.4 | −17.8 |
| | tan δ value | 0.68 | 0.69 | 0.72 | 0.69 | 0.78 | 0.80 |
| Microhardness | HM [N/mm$^2$] (Martens hardness) | 0.67 | 0.75 | 0.77 | 0.82 | 0.78 | 0.75 |
| | η IT [%] (Elastic work rate) | 86.0 | 87.8 | 91.2 | 93.3 | 91.5 | 93.7 |
| | CIT [%] (Creep) | 0.88 | 0.76 | 0.43 | 0.27 | 0.48 | 0.29 |

As can be seen from Table 1 and FIGS. 6 A and 6 B, the peak temperature of tan δ decreases as the amount of polyrotaxane added increases. That is, adding polyrotaxane to the layer including the ridgeline portion 151*c* of the cleaning blade 15*a* enables maintaining the rubber property of the ridgeline portion 151*c* even in the low temperature environment. Accordingly, the cleaning blade containing the polyrotaxane in the ridgeline portion can maintain rubber elasticity even in the low temperature environment, prevent a decrease in contact pressure, and obtain good cleaning properties even in the low temperature environment.

In addition, as can be seen from Table 1, the tensile strength of urethane rubber having the addition amount of the polyrotaxane 25% or more is smaller than the tensile strength of urethane rubber not added the polyrotaxane. Adding too much the polyrotaxane may deteriorate the wear resistance. Therefore, the amount of polyrotaxane added to the layer including the ridgeline portion 151*c* is preferably 15% or less.

The cleaning blade including the blade member with the two-layer structure may contain the polyrotaxane as a bulk in the backup layer 151*b* in addition to the edge layer. Adding the polyrotaxane in the backup layer 151*b* of the cleaning blade as described above is preferable because adding the polyrotaxane in the backup layer 151*b* enables maintaining the rubber property of the backup layer 151*b* in the low temperature environment and prevent the contact pressure from decreasing in the low temperature environment.

When the polyrotaxane is added to both the edge layer 151*a* and the backup layer 151*b*, the amount of the polyrotaxane added to the backup layer 151*b* is preferably smaller than the amount of the polyrotaxane added to the edge layer 151*a*. This is because a low tan δ peak temperature largely increases the elasticity in high temperature environments such as 35° C. and may cause curling of the cleaning blade, abnormal sound, and abnormal vibration of the cleaning blade. Therefore, the amount of the polyrotaxane added to the backup layer 151*b* is set to be smaller than the amount of the polyrotaxane added to the edge layer 151*a* so that the tan δ peak temperature in the backup layer 151*b* is not excessively lowered. The cleaning blade made as described above can maintain appropriate elasticity as a whole in both the low temperature environment and the high temperature environment. That is, the above-described setting of the cleaning blade can improve the cleaning properties in the low temperature environment and prevent the occurrence of curling, abnormal noise, and abnormal vibration of the cleaning blade in the high temperature environment.

Generally, hydrolysis deteriorates mechanical properties of ester urethane rubber blade members, such as tensile strength, hardness, etc. and is a technical issue as the cause of the contact pressure fluctuation between the cleaning blade and the photoconductor. To overcome the issue, preferably, the polyrotaxane includes an ether group attached to a hydroxyl group ((R1)-OH as illustrated in Chemical Formula 1) that constitutes cyclic molecules. Attaching the ether group makes the urethane rubber blade member to hardly hydrolyze. Attaching the ether group prevents the deterioration of the mechanical properties of the urethane rubber blade member such as the tensile strength and the hardness, caused by the hydrolysis. As a result, the cleaning blade can maintain good cleaning properties over time.

As a method for producing the polyrotaxane, for example, JP-6286439-B (WO2015/041322) discloses a known production method. The following production method can provide the ether-based polyrotaxane including the ether group attached to the hydroxyl group ((R1)-OH as illustrated in Chemical Formula 1). Firstly, polyethylene glycol (PEG), 2,2,6,6-tetramethyl-1-piperidinyloxy radical (TEMPO), and sodium bromide are dissolved in water. Next, sodium hydroxide or the like is added to cause a reaction in a strong alkali, and then ethanol is added to terminate the reaction, and α-cyclodextrin dissolved in water is added thereto to obtain an inclusion complex. Next, adamantaneamine is further added to the obtained inclusion complex and reacted to obtain polyrotaxane in which the terminal of PEG is sealed with adamantane. Next, the polyrotaxane is taken out by filtration and dried, and then a cyclic ether such as tetrahydrofuran (THF) is added thereto, followed by heating and stirring. Thus, an ether-based polyrotaxane in which THF is grafted to α-cyclodextrin is obtained.

Evaluation tests performed by the present inventors are described below. In the evaluation tests, the present inventors made 38 samples of the cleaning blades 15*a* including the blade member having the single-layer structure as illustrated in FIG. 3A, No. 1 to No. 38, and 7 comparative samples of the cleaning blades 15*a*, No. 1 to No. 7, and evaluated cleaning performance under the low temperature environment and a ware rate in each of the cleaning blades 15*a*.

Firstly, production of the comparative samples of the cleaning blades No. 1 to No. 7 is described.

Comparative Sample No. 1

(Preparation of prepolymer)

Eighteen parts of Coronate T-100 (Tosoh Corporation) is added to 100 parts of Placcel 220N (Daicel Corporation), heated under 100° C. and a vacuum environment, and stirred for 30 minutes to obtain a prepolymer A having isocyanate groups at both ends.

(Preparation of Curing Agent)

Trimethylolpropane (manufactured by Kanto Chemical Co., Inc.) and 1,4-butanediol (manufactured by Kanto Chemical Co., Inc.) were mixed at a ratio of 23:77 and heated to 100° C. so that the whole mixture became a uniform liquid, thereby obtaining a curing agent A.

(Urethane Rubber Molding)

Four parts of the curing agent A is added to 100 parts of the prepolymer A. With the amount the curing agent added, the Martens hardness of the rubber became about 0.3 [N/mm$^2$]. The mixture was mixed by a planetary centrifugal mixer so that the curing agent A is sufficiently dispersed in 100 parts of the prepolymer. The mixture mixed by the planetary centrifugal mixer was poured onto the surfaces of a centrifugal molding machine coated with a silicone-based release agent. The centrifugal molding machine was rotated at 1000 rounds per minute (rpm) for 30 minutes under 120° C. to heat and thermally cure the mixture and form a urethane rubber sheet. The urethane rubber sheet was taken out of the surface of the centrifugal molding machine after rotations of the centrifugal molding machine was stopped and placed on a flat metal plate. The urethane rubber sheet was placed in a constant temperature and humidity chamber set at a temperature of 35° C. and a humidity of 85% for one week to complete the reaction of unreacted isocyanate groups and obtain a urethane rubber.

The obtained urethane rubber was cut into a predetermined size to obtain a rubber strip for the cleaning blade. The comparative sample of the cleaning blade No. 1 was obtained by bonding the rubber strip to a predetermined sheet metal.

Comparative Samples No. 2 and No. 3

The comparative samples of the cleaning blades No. 2 and No. 3 were obtained as follows. That is, a predetermined amount of Coronate T-100 was additionally added to the prepolymer A so that the urethane rubber had a target Martens hardness. The target Martens hardness of the comparative sample of the cleaning blade No. 2 was 1.0 N/mm$^2$, and the target Martens hardness of the comparative sample of the cleaning blade No. 3 was 2.0 N/mm$^2$. Each of the above described mixtures was mixed by the planetary centrifugal mixer so that the Coronate T-100 was dispersed in the prepolymer A, and a predetermined amount of the curing agent A was added to the mixture. After that, the comparative samples of the cleaning blades No. 2 and No. 3 were made by the same processes of the comparative sample of the cleaning blade No. 1.

Comparative Samples No. 4 to No. 6

Comparative samples of the cleaning blades No. 4 to No. 6 were made by using prepolymer B containing PTG2000SN (Hodogaya Chemical Co., Ltd.) that is a material of the prepolymer. Other manufacturing processes of the comparative samples of the cleaning blades No. 4 to No. 6 are the same as the manufacturing processes of the comparative samples of the cleaning blades No. 1 to No. 3.

Comparative Sample No. 7

Comparative sample of the cleaning blade No. 7 was made by using prepolymer C containing Nipporan 4073 (Tosoh Corporation) that is a material of the prepolymer. Other manufacturing processes of the comparative sample of the cleaning blades No. 7 is the same as the manufacturing processes of the comparative sample of the cleaning blade No. 2. That is, the target Martens hardness of the comparative sample of the cleaning blade No. 7 was 1.0 N/mm$^2$.

Next, an evaluation method of the wear rate for the cleaning blade is described. A printing operation to wear the cleaning blade was performed under the following conditions.

<A Printing Operation to Wear the Cleaning Blade>

Evaluation environment:

23° C. and 50% RH

The image forming apparatus:

MPC5100S manufactured by RICOH CO., LTD.

A chart used in the printing operation:

Image area rate: 5% of A4 size (The printing operation was performed so that the longer side of A4 sheet was parallel to the photoconductor axis)

Photoconductor running distance in the printing operation: 200 km

<Measurement of the Wear Rate>

Figure 7:
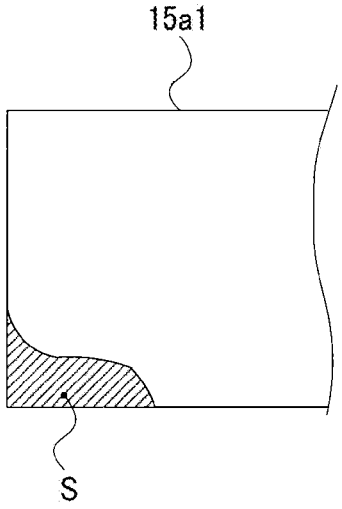
FIG. 7 is a schematic view to describe a wear area.

In measurement of the ware rate in the cleaning blade, a ware area S μm$^2$ was determined by observing a three-dimensional image of the tip of the cleaning blade after the printing operation with the laser microscope VK-9500 manufactured by KEYENCE CORPORATION. The wear area S is a cross-sectional area of a portion lost from the initial state by the printing operation, as illustrated in the hatched portion in FIG. 7. The ware rate in the cleaning blade was determined by dividing the wear area S determined above by the photoconductor traveling distance (200 km).

The cleaning performance under the low temperature environment was evaluated by visually observing printed charts in a printing operation in the low temperature environment. The following is conditions of the printing operation.

<A Printing Operation to Evaluate the Cleaning Performance>

Evaluation environment:

10° C. and 15% RH

The image forming apparatus:

MPC5100S manufactured by RICOH CO., LTD.

The cleaning blade:

The cleaning blade after the printing operation to wear the cleaning blade.

In the printing operation, the photoconductor rotated until the photoconductor travel distance reaches 200 km.

A chart for evaluation:

A chart including vertical solid band in the A4 size (Printing was performed so that the longer side of A4 sheet was parallel to the photoconductor axis)

A number of printed sheets in the evaluation:

1000 sheets

Figure 8:
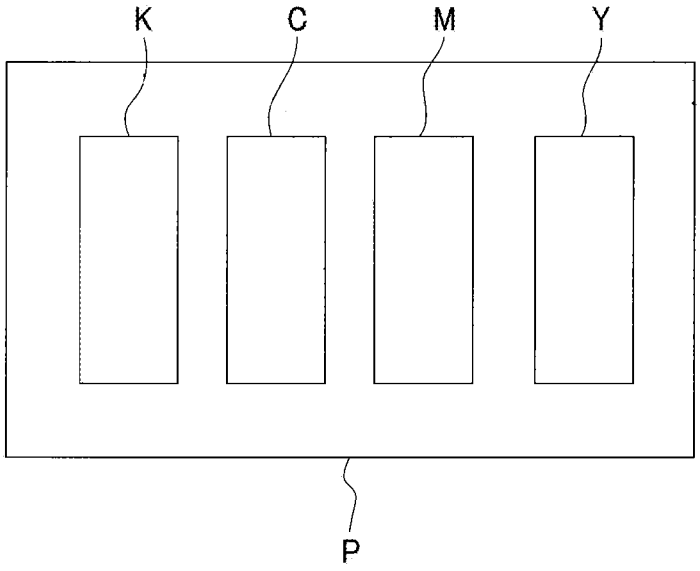
FIG. 8 is a schematic view of a chart used in a printing operation under a low temperature to evaluate a cleaning performance.

FIG. 8 is a schematic view of the chart for the evaluation used in the printing operation under the low temperature environment to evaluate the cleaning performance. As illustrated in FIG. 8, black, cyan, magenta and yellow vertical solid bands are arranged at predetermined intervals in the chart.

Figure 9A:
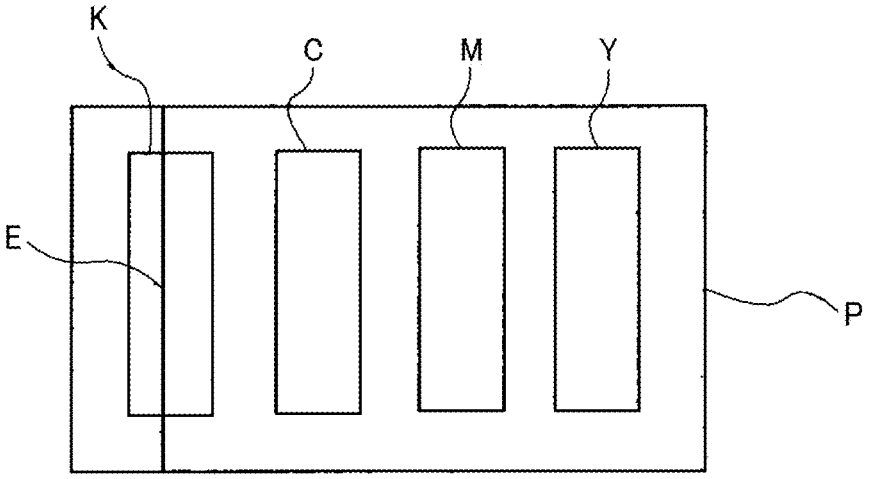
FIGS. 9A to 9C are schematic diagrams illustrating some examples of abnormal images due to cleaning failures on printouts of the chart in FIG. 8.
Figure 9B:
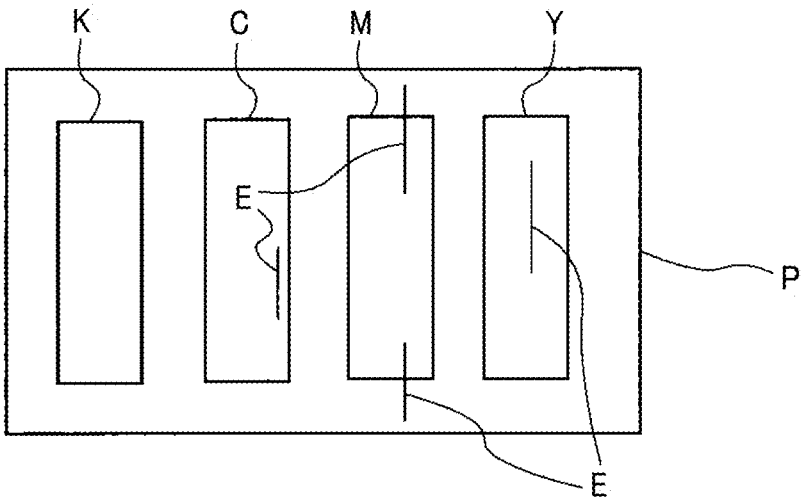
Figure 9C:
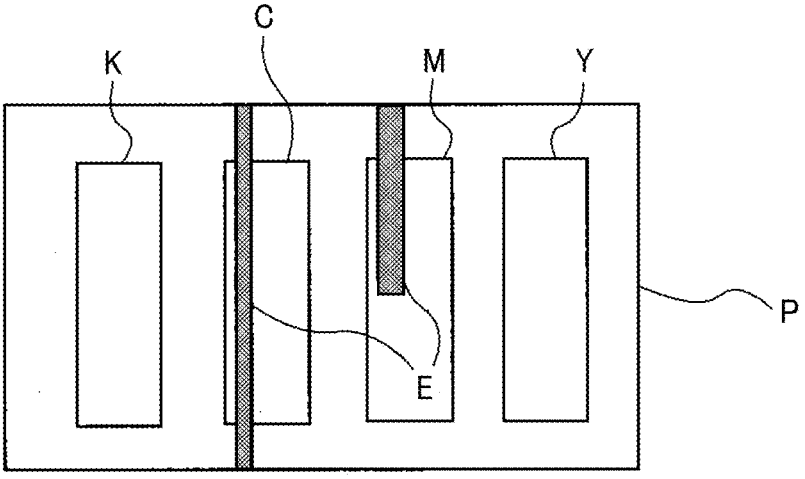

FIGS. 9A to 9C are schematic diagrams illustrating some examples of abnormal images due to cleaning failures.

FIG. 9A is an example in which the cleaning failure occurs in the black vertical solid band K, and a streak-shaped abnormal image E are continuously generated on the image. FIG. 9B is an example in which the cleaning failure occurs in the cyan, magenta, and yellow vertical solid band C, M, and Y, and a short streak-shaped abnormal images E occur intermittently. FIG. 9C is an example in which a large amount of the cleaning failure occurs in the cyan and magenta vertical solid band C and M in the width direction, which results in thick streak shaped abnormal images E. As described above, the cleaning failure often occurs corresponding to the vertical solid bands in the chart because much toner is input to the cleaning blade corresponding to the vertical solid bands.

The evaluation of the cleaning performance under the low temperature environment is performed by visually checking whether any one of abnormal images E as illustrated in FIGS. 9A to 9C exists in 1000 sheets printed the chart for the evaluation.

Cleaning performance levels, four levels are defined as follows based on images printed in the printing operation under the low temperature environment described above.

Good: No abnormal image due to the cleaning failure is found in one thousand sheets printed in the printing operation.

Fair: The abnormal image due to the cleaning failure is found in ten or less sheets of the one thousand sheets printed in the printing operation.

Poor: The abnormal image due to the cleaning failure is found in eleven to thirty sheets of the one thousand sheets printed in the printing operation.

Very poor: The abnormal image due to the cleaning failure is found in thirty one or more sheets of the one thousand sheets printed in the printing operation.

The following table 2 lists physical properties of the comparative samples of the cleaning blades No. 1 to No. 7, the ware rates, and results of the cleaning performance evaluation under the low temperature environment.

TABLE 2

| | | Comparative Samples' No. | | | | | | |
|---|---|---|---|---|---|---|---|---|
| | | 1 | 2 | 3 | 4 | 5 | 6 | 7 |
| Blade member structure | | Single layer blade member | | | | | | |
| Cleaning area | Main chain structure of urethane rubber | PCL (ester based) Prepolymer A | | | PTMG (ether based) Prepolymer B | | | Adipate Prepolymer C |
| | Curing agent type (polyrotaxane added or not) | Curing agent A (polyrotaxane not added) | | | | | | |
| | Amount of polyrotaxane added [%] | 0% | | | | | | |
| | Martens hardness [N/mm$^2$] | 0.29 | 1.10 | 2.11 | 0.31 | 1.08 | 2.01 | 0.98 |
| Electrical characteristics | Volume resistivity [Ω · cm] | $1.6 \times 10^{10}$ | $2.4 \times 10^{10}$ | $3.1 \times 10^{10}$ | $1.3 \times 10^{10}$ | $3.5 \times 10^{10}$ | $3.8 \times 10^{10}$ | $2.0 \times 10^{10}$ |
| | Surface resistivity [Ω] | $3.5 \times 10^{10}$ | $2.1 \times 10^{10}$ | $2.9 \times 10^{10}$ | $1.1 \times 10^{10}$ | $5.1 \times 10^{10}$ | $5.3 \times 10^{10}$ | $4.8 \times 10^{10}$ |
| Wear rate [μm$^2$/km] | | 3.12 | 4.48 | 7.23 | 3.55 | 4.34 | 7.32 | 3.92 |
| Cleaning Performance under low temperature environment | | Fair | Poor | Very Poor | Fair | Poor | Very Poor | Poor |

The Martens hardness [N/mm$^2$] of each sample in Table 2 was measured as follows.

Measuring instrument: HM2000 made by Fischer Instruments K.K.

Load: 1 mN

Indentation time: 10 seconds (s)

Creeping time: 5 s

Measuring position:

at a position 20 μm away from the edge of the cleaning blade on the face of the cleaning blade facing the surface of the photoconductor or at a position 20 μm away from the edge on the end face forming a right angle with the face of the cleaning blade facing the surface of the photoconductor.

Indenter: Vickers indenter

Measurement environment: 23° C., 50%

The volume resistivity in Table 2 was measured by the following method using Hiresta-UX manufactured by Nittoseiko Analytech Co., Ltd. The sample to be measured was placed on the electrode coupled to the Hiresta-UX, and the probe was placed on the sample after the sample was left at a test temperature (23° C., 50% RH) for 4 hours or more. An applied voltage was set to 500 V. After the voltage was applied for ten seconds, the resistance value [Ω] was read. The thickness of the sample was measured by a caliper or the like, and the volume resistivity was calculated by the following formula 1.

Volume resistivity $\rho V$[Ω·cm]=resistance value×volume resistivity coefficient÷sample thickness (Formula 1)

The volume resistivity coefficient is different for each probe, and a value calibrated by an apparatus manufacturer is usually disclosed and used.

The surface resistivity in Table 2 was similarly measured by the following method using Hiresta-UX manufactured by Nittoseiko Analytech Co., Ltd. The sample to be measured was placed on the insulation resin plate, and the probe was placed on the sample after the sample was left at a test temperature (23° C., 50% RH) for 4 hours or more. An applied voltage was set to 500 V. After the voltage was applied for ten seconds, the resistance value [Ω] was read. The surface resistivity was calculated by the following formula 2.

Surface resistivity $\rho S$[Ω]=resistance value×surface resistance coefficient (formula 2)

The surface resistivity coefficient is different for each probe, and a value calibrated by the apparatus manufacturer is usually disclosed and used.

As illustrated in Table 2, comparison between the comparative samples of the cleaning blades No. 1 to No. 3 gives a result that the larger the Martens hardness, the higher the wear rate. In addition, the higher the wear rate, the worse the cleaning performance in the low temperature environment. The same tendency was observed when the comparative samples of the cleaning blades No. 4 to No. 6 were compared.

The following describes samples of the cleaning blades No. 1 to No. 9 according to the present embodiment.

[Sample No. 1]

(Preparation of prepolymer)

The prepolymer was the same prepolymer A as in the comparative samples of the cleaning blades No. 1 to No. 3.

(Preparation of Curing Agent)

1,4-butanediol (manufactured by Kanto Chemical Co., Inc.), trimethylolpropane (manufactured by Kanto Chemical Co., Inc.), and ester-based polyrotaxane (product name: SH1300P manufactured by ASM Inc.) were mixed at a ratio of 33:6:61 and heated to 100° C. so that the whole mixture became a uniform liquid, thereby obtaining a curing agent C.

(Urethane Rubber Molding)

1.7 parts of the curing agent C was added to 100 parts of the prepolymer A. With the amount of the curing agent added, an amount of the polyrotaxane added became 1% of the total amount. The mixture was mixed by the planetary centrifugal mixer so that the curing agent C is sufficiently dispersed in the prepolymer A. Thereafter, the same rubber molding as in the comparative sample of the cleaning blade No. 1 was performed to obtain the urethane rubber of the sample of the cleaning blade No. 1. The obtained urethane rubber was cut into a predetermined size to obtain a rubber strip for the cleaning blade. The sample of the cleaning blade No. 1 was obtained by bonding the rubber strip to a predetermined sheet metal.

[Samples No. 2 to No. 9]

The samples of the cleaning blades No. 2 to No. 9 were made by the same manufacturing processes as the sample of the cleaning blade No. 1 other than the following process. In the manufacturing process different from the manufacturing process for the sample of the cleaning blade No. 1, a predetermined amount of Coronate T-100 was additionally added to the prepolymer A so that the urethane rubber had a target Martens hardness, and after the planetary centrifugal mixer mixed the mixture so that the Coronate T-100 A was dispersed in the prepolymer A, a predetermined amount of the curing agent C was added so that the proportion of the addition amount of the polyrotaxane became a target proportion.

The samples of the cleaning blades No. 1 to No. 3 containing 1% polyrotaxane had three different levels of Martens hardness (0.3 [N/mm$^2$], 1.0 [N/mm$^2$], and 2.0 [N/mm$^2$]) as the comparative samples of the cleaning blades No. 1 to No. 3.

The samples of the cleaning blades No. 4 to No. 6 contained 5% polyrotaxane (that is, the curing agent C: 8.9 parts) and had the three different levels of Martens hardness (0.3 [N/mm2], 1.0 [N/mm2], and 2.0 [N/mm2]).

The sample of the cleaning blade No. 7 was made so as to contain 10% polyrotaxane (that is, the curing agent C: 19.6 parts) and have the Martens hardness 1.0 [N/mm2]. The sample of the cleaning blade No. 8 was made so as to contain 20% polyrotaxane and have the Martens hardness 2.0 [N/mm$^2$]. The sample of the cleaning blade No. 9 was made so as to contain 50% polyrotaxane and have the Martens hardness 2.0 [N/mm$^2$].

The above-described samples of the cleaning blades No. 1 to No. 9 were evaluated for the ware rates and the cleaning performance in the low temperature environment similar to the evaluation for the comparative samples of the cleaning blades No. 1 to No. 7. The results are illustrated in Table 3 below.

TABLE 3

| | | Samples' No. | | | | | | | | |
|---|---|---|---|---|---|---|---|---|---|---|
| | | 1 | 2 | 3 | 4 | 5 | 6 | 7 | 8 | 9 |
| Blade member structure | | Single layer blade member | | | | | | | | |
| Cleaning area | Main chain structure of urethane rubber | PCL (ester based) Prepolymer A | | | | | | | | |
| | Curing agent type | Curing agent C (polyrotaxane: SH1300P manufactured by ASM Inc.) | | | | | | | | |
| | Amount of polyrotaxane added [%] | 1% | 1% | 1% | 5% | 5% | 5% | 10% | 20% | 50% |
| | Martens hardness [N/mm$^2$] | 0.28 | 1.08 | 2.12 | 0.29 | 1.1 | 2.24 | 1.11 | 2.12 | 2.23 |
| Electrical characteristics | Volume resistivity [Ω · cm] | $2.8 \times 10^{10}$ | — | $5.1 \times 10^{11}$ | $4.8 \times 10^{11}$ | — | $3.2 \times 10^{11}$ | — | — | $2.1 \times 10^{11}$ |
| | Surface resistivity [Ω] | $1.6 \times 10^{11}$ | — | $6.4 \times 10^{10}$ | $5.9 \times 10^{10}$ | — | $5.1 \times 10^{10}$ | — | — | $7.1 \times 10^{10}$ |
| Wear rate [μm$^2$/km] | | 2.51 | 3.62 | 5.71 | 2.21 | 3.18 | 5.02 | 3.09 | 5.69 | 5.82 |
| Cleaning Performance under low temperature environment | | Good | Good | Fair | Good | Good | Fair | Good | Good | Good |

As is clear from the comparison between the comparative sample of the cleaning blade No. 1 and the sample of the cleaning blade No. 1, between the comparative sample of the cleaning blade No. 2 and the sample of the cleaning blade No. 2, and between the comparative sample of the cleaning blade No. 3 and the sample of the cleaning blade No. 3, the samples of the cleaning blades containing 1% of polyrotaxane had smaller wear rates and better cleaning performance in the low temperature environment than the comparative samples of the cleaning blades containing no polyrotaxane. As is clear from the comparison between the sample of the cleaning blade No. 1 and the sample of the cleaning blade No. 4, between the sample of the cleaning blade No. 2 and the sample of the cleaning blade No. 5, and between the sample of the cleaning blade No. 3 and the sample of the cleaning blade No. 6, the samples of the cleaning blades No. 4 to No. 6 containing 5% polyrotaxane had smaller wear rates than the samples of the cleaning blades No. 1 to No. 3 containing 1% polyrotaxane.

In addition, as is clear from the comparison between the samples of the cleaning blades No. 5 and No. 7 and between the samples of the cleaning blades No. 6, 8, and 9, the wear rate in the sample of the cleaning blade containing 5% polyrotaxane is almost the same as the wear rate in the samples of the cleaning blades containing 10% or more polyrotaxane. As is clear from the comparison between the samples of the cleaning blades No. 6 and No. 8 and between the samples of the cleaning blades No. 6 and No. 9, the samples of the cleaning blades No. 8 and No. 9 containing more polyrotaxane than the sample of the cleaning blade No. 6 had better cleaning performance in the low temperature environment than the sample of the cleaning blade No. 6.

The following describes samples of the cleaning blades No. 10 to No. 18.

[Samples No. 10 to No. 18]

The samples of the cleaning blades No. 10 to No. 18 were made by the same manufacturing processes as the samples of the cleaning blades No. 1 to No. 9 other than the process using a curing agent D made by using ether-based polyrotaxane as the polyrotaxane in the curing agent. The ether-based polyrotaxane includes a polytetramethylene ether glycol (PTMG) chain.

The samples of the cleaning blades No. 10 to No. 12 contained 1% polyrotaxane and had the three different levels of Martens hardness (0.3 [N/mm$^2$], 1.0 [N/mm$^2$], and 2.0 [N/mm$^2$]), which are the same as the samples of the cleaning blades No. 1 to No. 3. The samples of the cleaning blades No. 13 to No. 15 contained 5% polyrotaxane and had the three different levels of Martens hardness (0.3 [N/mm$^2$], 1.0 [N/mm$^2$], and 2.0 [N/mm$^2$]), which are the same as the samples of the cleaning blades No. 4 to No. 6. The sample of the cleaning blade No. 16 contained 10% polyrotaxane that is the same as the sample of the cleaning blade No. 7, and the target Martens hardness was 1.0 [N/mm$^2$] that is the same as the sample of the cleaning blade No. 7. The sample of the cleaning blade No. 17 contained 20% polyrotaxane that is the same as the sample of the cleaning blade No. 8, and the target Martens hardness was 2.0 [N/mm$^2$] that is the same as the sample of the cleaning blade No. 8. The sample of the cleaning blade No. 18 contained 50% polyrotaxane that is the same as the sample of the cleaning blade No. 9, and the target Martens hardness was 2.0 [N/mm$^2$] that is the same as the sample of the cleaning blade No. 9.

The above-described samples of the cleaning blades No. 10 to No. 18 were evaluated for the ware rates and the cleaning performance in the low temperature environment similar to the evaluation for the comparative samples of the cleaning blades No. 1 to No. 7. The results are illustrated in Table 4 below.

TABLE 4

| | | Samples' No. | | | | | | | | |
|---|---|---|---|---|---|---|---|---|---|---|
| | | 10 | 11 | 12 | 13 | 14 | 15 | 16 | 17 | 18 |
| Blade member structure | | Single layer blade member | | | | | | | | |
| Cleaning area | Main chain structure of urethane rubber | PCL (ester based) Prepolymer A | | | | | | | | |
| | Curing agent type | Curing agent D (polyrotaxane: ether based polyrotaxane) | | | | | | | | |
| | Amount of polyrotaxane added [%] | 1% | 1% | 1% | 5% | 5% | 5% | 10% | 20% | 50% |
| | Martens hardness [N/mm$^2$] | 029 | 1.11 | 2.19 | 0.29 | 1.09 | 2.21 | 1.13 | 2.11 | 2.31 |
| Electrical characteristics | Volume resistivity [Ω · cm] | $1.1 \times 10^{10}$ | — | $3.2 \times 10^{10}$ | $7.2 \times 10^{10}$ | — | $6.2 \times 10^{10}$ | — | — | $5.1 \times 10^{10}$ |
| | Surface resistivity [Ω] | $8.8 \times 10^{10}$ | — | $1.9 \times 10^{11}$ | $5.9 \times 10^{11}$ | — | $8.3 \times 10^{10}$ | — | — | $9.8 \times 10^{10}$ |
| Wear rate [μm$^2$/km] | | 2.87 | 3.44 | 5.93 | 2.51 | 2.99 | 4.98 | 3.01 | 5.98 | 6.05 |
| Cleaning Performance under low temperature environment | | Good | Good | Fair | Good | Good | Fair | Good | Good | Good |

As illustrated in Table 4, the same tendency as in the samples of the cleaning blades No. 1 to No. 9 can be seen in the samples of the cleaning blades No. 10 to No. 18. That is, the samples of the cleaning blades containing polyrotaxane had smaller wear rates and better cleaning performance in the low temperature environment than the comparative samples of the cleaning blades No. 1 to No. 3 containing no polyrotaxane. The samples of the cleaning blades No. 13 to No. 15 containing 5% polyrotaxane had smaller wear rates than the samples of the cleaning blades No. 10 to No. 12 containing 1% polyrotaxane. In addition, the wear rate in the sample of the cleaning blade containing 5% polyrotaxane is almost the same as the wear rates in the samples of the cleaning blades containing 10% or more polyrotaxane. The comparison between the samples of the cleaning blades No. 15, No. 17, and No. 18 suggests that increasing the content of polyrotaxane improves the cleaning performance in the low temperature environment. The above-described results confirm that the ether-based polyrotaxane also has the same effect as the ester-based polyrotaxane.

The following describes samples of the cleaning blades No. 19 to No. 27.

[Samples No. 19 to No. 27]

The samples of the cleaning blades No. 19 to No. 27 were made by using prepolymer B containing PTG2000SN (Hodogaya Chemical Co., Ltd.) that is a material of the prepolymer. Other manufacturing processes of the samples of the cleaning blades No. 19 to No. 27 are the same as the manufacturing processes of the samples of the cleaning blades No. 1 to No. 9.

The above-described samples of the cleaning blades No. 19 to No. 27 were evaluated for the ware rates and the cleaning performance in the low temperature environment similar to the evaluation for the comparative samples of the cleaning blades No. 1 to No. 7. The results are illustrated in Table 5 below.

TABLE 5

| | | Samples' No. | | | | | | | | |
|---|---|---|---|---|---|---|---|---|---|---|
| | | 19 | 20 | 21 | 22 | 23 | 24 | 25 | 26 | 27 |
| Blade member structure | | Single layer blade member | | | | | | | | |
| Cleaning area | Main chain structure of urethane rubber | PTMG (ether based) Prepolymer B | | | | | | | | |
| | Curing agent type | Curing agent C (polyrotaxane: SH1300P manufactured by ASM Inc.) | | | | | | | | |
| | Amount of polyrotaxane added [%] | 1% | 1% | 1% | 5% | 5% | 5% | 10% | 20% | 50% |
| | Martens hardness [N/mm$^2$] | 0.27 | 1.01 | 2.02 | 0.28 | 1.07 | 1.99 | 1.01 | 1.99 | 2.12 |
| Electrical characteristics | Volume resistivity [Ω · cm] | $7.5 \times 10^{10}$ | — | $3.1 \times 10^{10}$ | $1.1 \times 10^{11}$ | — | $1.2 \times 10^{11}$ | — | — | $2.4 \times 10^{11}$ |
| | Surface resistivity [Ω] | $5.2 \times 10^{10}$ | — | $2.2 \times 10^{10}$ | $9.2 \times 10^{10}$ | — | $3.3 \times 10^{11}$ | — | — | $8.7 \times 10^{11}$ |

TABLE 5-continued

| | Samples' No. | | | | | | | | |
|---|---|---|---|---|---|---|---|---|---|
| | 19 | 20 | 21 | 22 | 23 | 24 | 25 | 26 | 27 |
| Wear rate [$\mu m^2$/km] | 2.21 | 3.12 | 5.19 | 1.89 | 2.68 | 4.82 | 2.71 | 5.11 | 5.31 |
| Cleaning Performance under low temperature environment | Good | Good | Fair | Good | Good | Fair | Good | Good | Good |

As illustrated in Table 5, the same tendency as in the samples of the cleaning blades No. 1 to No. 9 can be seen in the samples of the cleaning blades No. 19 to No. 27. That is, the samples of the cleaning blades No. 19 to No. 27 containing polyrotaxane had smaller wear rates and better cleaning performance in the low temperature environment than the comparative samples of the cleaning blades No. 4 to No. 6 made of the prepolymer B containing no polyrotaxane. The samples of the cleaning blades No. 22 to No. 24 containing 5% polyrotaxane had smaller wear rates than the samples of the cleaning blades No. 19 to No. 21 containing 1% polyrotaxane. In addition, the wear rate in the sample of the cleaning blade containing 5% polyrotaxane is almost the same as the wear rates in the samples of the cleaning blades containing 10% or more polyrotaxane. The results in Table 5 suggest that increasing the content of polyrotaxane improves the cleaning performance in the low temperature environment. The above-described results suggest that urethane rubber having a main chain structure that is the combination of ether-based material (i.e. polytetramethylene ether glycol (PTMG)) and ester-based polyrotaxane also has the same effect as the urethane rubber as described above.

The following describes samples of the cleaning blades No. 28 to No. 36.

[Samples No. 28 to No. 36]

The samples of the cleaning blades No. 28 to No. 36 were made by the same manufacturing processes as the samples of the cleaning blades No. 19 to No. 27 other than the process using a curing agent D made by using ether-based polyrotaxane as the polyrotaxane in the curing agent.

The above-described samples of the cleaning blades No. 28 to No. 36 were evaluated for the ware rates and the cleaning performance in the low temperature environment similar to the evaluation for the comparative samples of the cleaning blades No. 1 to No. 7. The results are illustrated in Table 6 below.

TABLE 6

| | | Samples' No. | | | | | | | | |
|---|---|---|---|---|---|---|---|---|---|---|
| | | 28 | 29 | 30 | 31 | 32 | 33 | 34 | 35 | 36 |
| Blade member structure | | Single layer blade member | | | | | | | | |
| Cleaning area | Main chain structure of urethane rubber | PTMG (ether based) Prepolymer B | | | | | | | | |
| | Curing agent type | Curing agent D (polyrotaxane: ether based polyrotaxane) | | | | | | | | |
| | Amount of polyrotaxane added [%] | 1% | 1% | 1% | 5% | 5% | 5% | 10% | 20% | 50% |
| | Martens hardness [$N/mm^2$] | 0.29 | 1.13 | 2.12 | 0.31 | 1.21 | 2.28 | 1.01 | 1.99 | 2.12 |
| Electrical characteristics | Volume resistivity [$\Omega \cdot cm$] | $2.4 \times 10^{11}$ | — | $3.5 \times 10^{10}$ | $1.3 \times 10^{11}$ | — | $8.1 \times 10^{10}$ | — | — | $3.2 \times 10^{11}$ |
| | Surface resistivity [$\Omega$] | $1.2 \times 10^{10}$ | — | $2.2 \times 10^{10}$ | $1.1 \times 10^{11}$ | — | $8.9 \times 10^{10}$ | — | — | $9.1 \times 10^{11}$ |
| Wear rate [$\mu m^2$/km] | | 2.49 | 3.11 | 5.48 | 2.12 | 2.59 | 4.61 | 2.67 | 5.29 | 5.61 |
| Cleaning Performance under low temperature environment | | Good | Good | Fair | Good | Good | Fair | Good | Good | Good |

As illustrated in Table 6, the same tendency as in the samples of the cleaning blades No. 19 to No. 27 can be seen in the samples of the cleaning blades No. 28 to No. 36. The above-described results suggest that urethane rubber having a main chain structure that is the combination of ether-based material (i.e. polytetramethylene ether glycol (PTMG)) and ether-based polyrotaxane also has the same effect as the urethane rubber as described above.

The following describes samples of the cleaning blades No. 37 and No. 38.

[Samples No. 37 and No. 38]

The sample of the cleaning blade No. 37 was made by the same manufacturing processes as the comparative sample of the cleaning blade No. 7 other than a process using the curing agent C. The sample of the cleaning blade No. 38 was made by the same manufacturing processes as the comparative sample of the cleaning blade No. 7 other than a process using the curing agent D.

The above-described samples of the cleaning blades No. 37 and No. 38 were evaluated for the ware rates and the cleaning performance in the low temperature environment similar to the evaluation for the comparative samples of the cleaning blades No. 1 to No. 7. The results are illustrated in Table 7 below.

TABLE 7

| | | Samples' No. | |
|---|---|---|---|
| | | 37 | 38 |
| Blade member structure | | Single layer blade member | Single layer blade member |
| Cleaning area | Main chain structure of urethane rubber | Adipate Prepolymer C | Adipate Prepolymer C |
| | Curing agent type | Curing agent C (polyrotaxane: SH1300P manufactured by ASM Inc.) | Curing agent D (polyrotaxane: ether based polyrotaxane) |
| | Amount of polyrotaxane added [%] | 5% | 5% |
| | Martens hardness [N/mm$^2$] | 0.93 | 1.01 |
| Electrical characteristics | Volume resistivity [Ω · cm] | $2.1 \times 10^{10}$ | $4.3 \times 10^{10}$ |
| | Surface resistivity [Ω] | $1.2 \times 10^{10}$ | $2.4 \times 10^{10}$ |
| Wear rate [μm$^2$/km] | | 2.84 | 2.97 |
| Cleaning Performance under low temperature environment | | Good | Good |

As illustrated in Table 7, the samples of the cleaning blades No. 37 and 38 containing polyrotaxane had smaller wear rates and better cleaning performance in the low temperature environment than the comparative samples of the cleaning blade No. 7 containing no polyrotaxane. The above-described results suggest that urethane rubber having the main chain structure that is the combination of adipate and ester-based polyrotaxane or the combination of adipate and ether-based polyrotaxane can also improve the cleaning performance in the low temperature environment and reduce the ware rate. Additionally, the present inventors made cleaning blades containing the prepolymer C with different addition ratios of the polyrotaxane, evaluated the cleaning performance in the low temperature environment and the ware rate, and found the same tendency as the samples of the cleaning blades No. 1 to No. 9.

The results in the above evaluation tests show that the urethane rubber added the polyrotaxne has the pulley effect that reduces the ware rate of the cleaning blade and improves the durability of the cleaning blade. In addition, adding the polyrotaxane to the urethane rubber lowers the glass transition temperature of the urethane rubber, which enables maintaining a sufficient rubber property even in the low temperature environment. Therefore, the contact pressure of the cleaning blade including the urethan rubber added the polyrotaxane does not decrease in the low temperature environment, and cleaning can be favorably performed even in the low temperature environment. The amount of polyrotaxane added is preferably 5% or more and 20% or less. Compared with setting the amount of the polyrotaxane added to be less than 5%, setting the amount of the polyrotaxane added to be 5% or more further improves the cleaning performance in the low temperature environment and reduce the ware rate. Since the above-described effects do not change when the amount of the polyrotaxane added is more than 20%, the amount of the polyrotaxane added is preferably 20% or less.

In the above-described evaluation tests, the single layer blade member was used. However, the polyrotaxane may be added to the edge layer 151*a* of the blade member having the two-layer structure including the edge layer 151*a* with the ridgeline portion 151*c* and the backup layer 151*b*. Adding the polyrotaxane to the edge layer 151*a* gives the same results as in the above-described evaluation tests.

The polyrotaxane may be contained in an elastic layer as a surface layer of a conveyance roller such as the registration rollers 9 and the sheet feed roller 8 that convey the recording sheet P.

Figure 10:
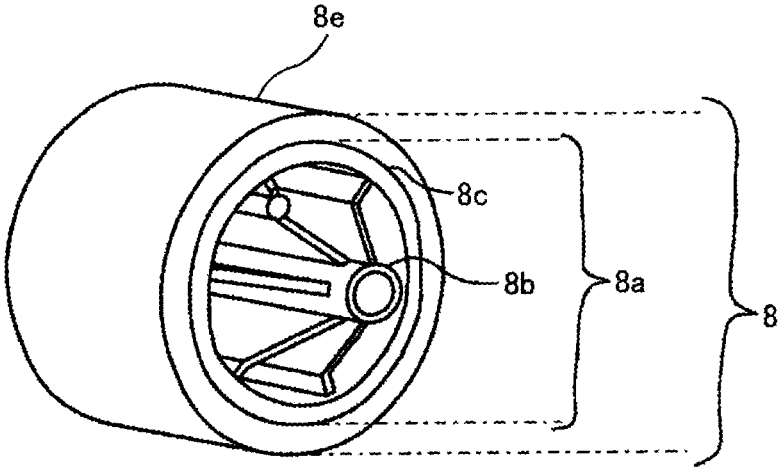
FIG. 10 is a perspective view illustrating a sheet feed roller as a conveyance roller of an embodiment of the present disclosure.

FIG. 10 is a perspective view illustrating the sheet feed roller 8 as the conveyance roller.

The sheet feed roller 8 includes a hub 8*a* as a core made of resin and an elastic layer 8*e* as a surface layer. The elastic layer 8*e* is made of an insulating elastic material such as urethane rubber having a volumetric resistance of $1\times10^{10}$ Ω·cm or more and covers the outer peripheral surface of the outer ring 8*c* of the hub 8*a*. The sheet feed roller 8 is attached in a state in which a rotary shaft is inserted into an internal space of an inner ring 8*b* of the hub 8*a*.

The rotation speed of the sheet feed roller 8 may vary due to manufacturing errors or the like. Therefore, the rotation speed of the sheet feed roller 8 may be slower than the rotation speed of the conveyance roller upstream from the sheet feed roller 8 in a sheet conveyance direction. When the rotation speed of the sheet feed roller 8 is slower than the rotation speed of the conveyance roller upstream in the sheet conveyance direction, the sheet feed roller 8 rotating slowly slips with respect to the recording sheet while the recording sheet is being conveyed by the sheet feed roller 8 and the conveyance roller. Similar to the cleaning blade, the above-described slipping movement causes stress concentration at the cross-linking points in the elastic layer 8*e*, molecular chains in the elastic layer 8*e* are cut, and the elastic layer 8*e* is worn. In addition, the low temperature environment deteriorates rubber elasticity of the elastic layer 8*e*, and the contact pressure between the sheet feed roller 8 and the recording sheet may change, thereby deteriorating the conveyance performance of the recording sheet.

Accordingly, adding the polyrotaxane as a bulk to the elastic layer 8*e* of the sheet feed roller 8 gives the elastic layer 8*e* the pully effect that reduces the ware of the elastic layer 8*e* and extends the life of the sheet feed roller 8. In addition, adding the polyrotaxane as a bulk to the elastic layer 8*e* lowers the tan δ peak temperature and enables maintaining a good sheet conveyance performance even in the low temperature environment.

In the above, the polyrotaxane is added as a bulk to the elastic layer 8*e* of the sheet feed roller 8. However, the polyrotaxane may be added as a bulk to an elastic layer of the conveyance roller such as one of the registration rollers 9, a sheet ejection roller, or the like, which extends the life of the conveyance roller and enables maintaining a good sheet conveyance performance even in the low temperature environment.

The embodiments described above are just examples, and the various aspects of the present disclosure attain respective effects as follows.

In a first aspect, a cleaning blade such as the cleaning blade 15*a* includes a ridgeline portion such as the ridgeline portion 151*c* containing polyrotaxane.

According to the first aspect, the cleaning blade including the ridgeline portion containing at least one of the polyrotaxane and the cross-linked polyrotaxane can have the ware rate smaller than the cleaning blade including the ridgeline portion not containing the polyrotaxane and the cross-linked polyrotaxane and extend the life of the cleaning blade.

In a second aspect, volume resistivity of the ridgeline portion of the cleaning blade according to the first aspect is $1\times10^{10}$ Ω·cm or more.

According to the second aspect, since the blade member does not contain conducting agent to make the ridgeline portion 151*c* conductive, the conducting agent does not affect the ridgeline portion and deterioration of the cleaning performance caused by the conducting agent does not occur. The ridgeline portion 151*c* of the cleaning blade according to the second aspect contacts an object to be cleaned and mechanically removes substances adhering to the surface of the object to be cleaned. Accordingly, the cleaning blade can favorably remove the substances from the surface of the object to be cleaned even if the volume resistivity of the ridgeline portion is $1\times10^{10}$ Ω·cm or more and not conductive.

In a third aspect, a cleaning blade such as the cleaning blade 15*a* includes a ridgeline portion such as the ridgeline portion 151*c* containing polyrotaxane, and the ridgeline portion has a volume resistivity of $1\times10^{10}$ Ω·cm or more.

According to the third aspect, the cleaning blade including the ridgeline portion containing at least one of the polyrotaxane and the cross-linked polyrotaxane can have the ware rate smaller than the cleaning blade including the ridgeline portion not containing the polyrotaxane and the cross-linked polyrotaxane and extend the life of the cleaning blade as described in the results of the evaluation tests.

In a fourth aspect, the cleaning blade according to any one of the first to third aspects includes a layer including the ridgeline portion such as the ridgeline portion 151*c*, and the layer contains polyrotaxane as a bulk.

According to the fourth aspect, the ridgeline portion 151*c* containing at least one of the polyrotaxane and the cross-linked polyrotaxane as a bulk can have the greater effect of containing the at least one of the polyrotaxane and the cross-linked polyrotaxane than the ridgeline portion locally containing the at least one of the polyrotaxane and the cross-linked polyrotaxane. That is, the pully effect reduces the ware rate, and lowering the tan δ peak temperature improves the cleaning performance in the low temperature environment.

In a fifth aspect, the cleaning blade includes a layer including the ridgeline portion such as the ridgeline portion 151*c*, and the layer contains polyrotaxane as a bulk.

According to the fifth aspect, the cleaning blade including the ridgeline portion containing at least one of the polyrotaxane and the cross-linked polyrotaxane can have the ware rate smaller than the cleaning blade including the ridgeline portion not containing the polyrotaxane and the cross-linked polyrotaxane and extend the life of the cleaning blade as described in the results of the evaluation tests.

In a sixth aspect, the cleaning blade according to any one of the first to fifth aspects includes the ridgeline portion such as the ridgeline portion 151*c* made of polyurethane rubber containing polyrotaxane.

According to the sixth aspect, the ridgeline portion such as the ridgeline portion 151*c* can have elasticity to follow the positional fluctuation of the surfaces of the member to be cleaned such as the photoconductor 11 and favorably maintain the contact pressure and obtain the favorable cleaning performance.

In a seventh aspect, the polyrotaxane in the cleaning blade according to any one of the first to sixth aspects has an ether base.

According to the seventh aspect, the hydrolysis is less likely occur, preventing the deterioration of the mechanical properties such as the tensile strength and the hardness, caused by the hydrolysis. As a result, good cleaning performance can be kept over time.

In an eighth aspect, the cleaning blade according to any one of the first to seventh aspects includes a blade member such as the blade member 15*a*1 including an edge layer such as the edge layer 151*a* including the ridgeline portion such as the ridgeline portion 151*c* and a backup layer such as the backup layer 151*b* layered on the edge layer.

According to the eighth aspect, the cleaning blade can maintain appropriate elasticity as a whole in both the low temperature environment and the high temperature environment.

In a ninth aspect, the backup layer such as the backup layer 151*b* in the cleaning blade according to the eighth aspect contains polyrotaxane.

According to the ninth aspect, the cleaning blade can maintain the rubber property of the backup layer such as the backup layer 151*b* in the low temperature environment and prevent the contact pressure from decreasing in the low temperature environment.

In a tenth aspect, a content of polyrotaxane in the backup layer such as the backup layer 151*b* of the cleaning blade according to the ninth aspect is different from a content of polyrotaxane in the edge layer such as the edge layer 151*a*.

According to the tenth aspect, since the tan δ peak temperature of the backup layer such as the backup layer 151*b* can be set to be different from the tan δ peak temperature of the edge layer such as the edge layer 151*a*, the cleaning blade can maintain appropriate elasticity as a whole in both the low temperature environment and the high temperature environment.

In an eleventh aspect, the content of polyrotaxane in the edge layer such as the edge layer 151*a* of the cleaning blade according to the tenth aspect is larger than the content of polyrotaxane in the backup layer such as the backup layer 151*b*.

According to the eleventh aspect, the tan δ peak temperature of the edge layer such as the edge layer 151*a* can be set to be lower than the tan δ peak temperature of the backup layer such as the backup layer 151*b*. Accordingly, the cleaning blade can maintain the rubber property of the ridgeline portion such as the ridgeline portion 151*c* in the low temperature environment and the appropriate contact pressure even in the low temperature environment. As a result, cleaning performance can be obtained. In addition, since the tan δ peak temperature of the backup layer such as the backup layer 151*b* can be set to be higher than the tan δ peak temperature of the edge layer such as the edge layer 151*a*, the elasticity of the blade member can be prevented from becoming too large in the high temperature environment. Consequently, the occurrence of curling, abnormal noise, and abnormal vibration of the cleaning blade in the high temperature environment can be prevented.

In a twelfth aspect, the tan δ peak temperature of the edge layer such as the edge layer 151*a* of the cleaning blade according to the eleventh aspect is lower than the tan δ peak temperature of the backup layer such as the backup layer 151*b*.

Consequently, good cleaning performance can be obtained in the low temperature environment, and the occurrence of curling, abnormal noise, and abnormal vibration of the cleaning blade in the high temperature environment can be prevented.

In a thirteenth aspect, an image forming apparatus such as the image forming apparatus 1 includes an image bearer such as the photoconductor 11 and the cleaning blade such as the cleaning blade 15*a* according to any one of the first to twelfth aspects to remove substances adhering to the surface of the image bearer.

The thirteenth aspect prevents occurrences of abnormal images caused by the cleaning failures over time and in the low temperature environment.

In a fourteenth aspect, a process cartridge such as one of the image forming units 10Y, 10C, 10M, and 10K includes an image bearer such as the photoconductor 11 and the cleaning blade such as the cleaning blade 15*a* according to any one of the first to twelfth aspects to remove substances adhering to the surface of the image bearer.

The fourteenth aspect can provide the process cartridge having a long life.

In a fifteenth aspect, a sheet conveyance roller such as the sheet feed roller 8 includes a core such as the hub 8*a* and a surface layer such as the elastic layer 8*e* containing polyrotaxane.

According to the fifteenth aspect, as described with reference to FIG. 10, the wear of the sheet conveyance roller and deterioration of the sheet conveyance performance in the low temperature environment can be prevented.

In a sixteenth aspect, the surface layer of the sheet conveyance roller according to the fifteenth aspect includes an elastic body.

According to the sixteenth aspect, a predetermined contact pressure between the sheet and the sheet conveyance roller can be obtained to satisfactorily convey the sheet.

In a seventeenth aspect, the volume resistivity of the surface layer of the sheet conveyance roller according to the fifteenth aspect or the sixteenth aspect is $15\times10^{10}$ Ω·cm or more.

According to the seventeenth aspect, since the surface layer does not contain conducting agent to make the surface layer conductive, the sheet conveyance performance cannot be affected by the conducting agent.

In an eighteenth aspect, the surface layer of the sheet conveyance roller according to any one of the fifteenth to seventeenth aspects contains polyrotaxane as a bulk.

According to the eighteenth aspect, the surface layer containing at least one of the polyrotaxane and the cross-linked polyrotaxane as a bulk can have the greater effect of containing the at least one of the polyrotaxane and the cross-linked polyrotaxane than the surface layer locally containing the at least one of the polyrotaxane and the cross-linked polyrotaxane. That is, the pully effect reduces the ware rate, and lowering the tan δ peak temperature improves the sheet conveyance performance in the low temperature environment.

In a nineteenth aspect, an image forming apparatus such as the image forming apparatus 1 includes the sheet conveying roller according to any one of the fifteenth to eighteenth aspects.

According to the nineteenth aspect, the sheet can be satisfactorily conveyed over time even in the low temperature environment.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. A cleaning blade configured to mechanically remove a substance from an image bearer, the cleaning blade comprising:

a blade member including an edge layer and a backup layer layered on the edge layer, the edge layer including a ridgeline portion configured to contact the image bearer, the ridgeline portion made of urethane rubber containing polyrotaxane and the backup layer including polyrotaxane at an amount smaller than that of the ridgeline portion.

2. The cleaning blade according to claim 1, wherein the ridgeline portion has elasticity and a volume resistivity of $1\times10^{10}$ Ω·cm or more.

3. The cleaning blade according to claim 1, wherein the edge layer contains the polyrotaxane as a bulk.

4. The cleaning blade according to claim 1, wherein the polyrotaxane has an ether base.

5. An image forming apparatus comprising:

an image bearer; and the cleaning blade according to claim 1 configured to remove substances adhering to a surface of the image bearer.

6. A process cartridge comprising:

an image bearer; and the cleaning blade according to claim 1 configured to remove substances adhering to a surface of the image bearer.

7. The cleaning blade according to claim 1, wherein the polyrotaxane and a prepolymer are mixed to make the urethane rubber such that the edge layer is formed from the urethane rubber having consistent concentration of the polyrotaxane therein.

8. A cleaning blade configured to mechanically remove a substance from an image bearer, the cleaning blade comprising:

a blade member including an edge layer and a backup layer layered on the edge layer, the edge layer including a ridgeline portion configured to contact the image bearer, the ridgeline portion made of urethane rubber containing polyrotaxane and the backup layer including polyrotaxane at an amount smaller than that of the ridgeline portion, the ridgeline portion having a volume resistivity of $1\times10^{10}$ Ω·cm or more.

9. The cleaning blade according to claim 8, wherein the edge layer contains the polyrotaxane as a bulk.

10. The cleaning blade according to claim 8, wherein the polyrotaxane has an ether base.

11. An image forming apparatus comprising:

an image bearer; and the cleaning blade according to claim 8 configured to remove substances adhering to a surface of the image bearer.

12. A process cartridge comprising:

an image bearer; and the cleaning blade according to claim 8 configured to remove substances adhering to a surface of the image bearer.

* * * * *